US011798345B2

(12) United States Patent
Barbour et al.

(10) Patent No.: US 11,798,345 B2
(45) Date of Patent: Oct. 24, 2023

(54) GAMING MACHINE WITH SLIDE-OUT BUTTON DECK ASSEMBLY AND MANUALLY OPERABLE PUSH-TO-RELEASE LATCH MECHANISM

(71) Applicant: Aristocrat Technologies Australia Pty Limited, North Ryde (AU)

(72) Inventors: Timothy Francis Barbour, Las Vegas, NV (US); Kiran Dundaraddi, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 870 days.

(21) Appl. No.: 15/922,236

(22) Filed: Mar. 15, 2018

(65) Prior Publication Data

US 2019/0096161 A1 Mar. 28, 2019

Related U.S. Application Data

(60) Provisional application No. 62/564,345, filed on Sep. 28, 2017.

(51) Int. Cl.
*G07F 17/32* (2006.01)

(52) U.S. Cl.
CPC ..... *G07F 17/3209* (2013.01); *G07F 17/3211* (2013.01); *G07F 17/3216* (2013.01); *G07F 17/3244* (2013.01)

(58) Field of Classification Search
CPC ..... G07F 17/3209; G07F 17/3211; G07F 17/3216; G07F 17/3244
USPC ..... 463/46
See application file for complete search history.

(56) References Cited

U.S. PATENT DOCUMENTS

2002/0155890 A1* 10/2002 Ha ..... A63F 13/28 463/36
2004/0048674 A1* 3/2004 Hussaini ..... A63F 13/02 463/46
2006/0186595 A1* 8/2006 Emori ..... G07F 17/3216 273/120 R
2008/0132340 A1* 6/2008 Haga ..... G07F 17/3216 463/46
2009/0093315 A1* 4/2009 Matsunaga ..... A63F 13/214 463/43
2009/0233681 A1* 9/2009 Tsukahara ..... G07F 17/3216 463/20

(Continued)

OTHER PUBLICATIONS

AU Examination Report for AU Application No. 2018204595, dated Jun. 26, 2019, 6 Pages.

*Primary Examiner* — Kang Hu
*Assistant Examiner* — Wei Lee
(74) *Attorney, Agent, or Firm* — Armstrong Teasdale LLP

(57) ABSTRACT

Gaming machines and systems include a slide-out player interface button deck including a video display and a glass insulator provided with a capacitive touch screen layer overlying the video display. A cast flange surrounds at least a portion of the button deck and is slidably attached and interlocked with the button deck via mating projections and openings. First and second drawer slide assemblies are coupled to the flange and a manually operable push-to release latch mechanism locks and unlocks the slide-out player interface for movement between a retracted position and an extending position relative to a gaming support structure.

19 Claims, 13 Drawing Sheets

(56) References Cited

U.S. PATENT DOCUMENTS

| | | | | |
|---|---|---|---|---|
| 2010/0124994 | A1* | 5/2010 | O'Keene | G07F 17/32<br>463/46 |
| 2016/0093142 | A1 | 3/2016 | Lamb | |

* cited by examiner

GAMING MACHINE WITH SLIDE-OUT BUTTON DECK ASSEMBLY AND MANUALLY OPERABLE PUSH-TO-RELEASE LATCH MECHANISM

CROSS REFERENCE TO RELATED APPLICATIONS

This application claims the benefit of U.S. Provisional Application Ser. No. 62/564,345 filed Sep. 28, 2017, the complete disclosure of which is hereby incorporated by reference in its entirety.

This application further relates in part to subject matter disclosed in U.S. patent application Ser. No. 15/686,688 filed Aug. 25, 2017 and entitled GAMING MACHINES, SYSTEMS, AND METHODS WITH CONFIGURABLE BUTTON DECK INCLUDING A DYNAMIC LOW PROFILE PUSHBUTTON ASSEMBLY, the entire disclosure of which is hereby incorporated by reference in its entirety.

BACKGROUND OF THE INVENTION

The embodiments described herein relate generally to gaming machines and, more particularly, to gaming machines and systems including a slidably mounted button deck assembly and manually operable latch release mechanism for the button deck assembly.

With advancements in graphics processors, multiple video displays are becoming more common in gaming machines. For example, a gaming machine may include a main game display and at least one secondary display coordinated by a game controller to provide a more immersive gaming experience. The secondary display may be associated with a player interface that enables the player to communicate with the gaming machine. Using the player interface, the player can make wagers, enable pay lines, cash-out accumulated credits, prompt a play of the game or make inter-game selections in a game of chance. Accordingly, the player interface typically includes a bill/card/voucher acceptor for accepting and/or validating cash bills, coupons, and ticket vouchers in order to play the game. These bill/card/voucher acceptors may also be enabled to accept player identification cards used in rewards/loyalty programs through which players are enrolled to obtain promotions. These promotions may be things such as gifts, meals or cash back to the player based upon the player's wagering activities tracked via presentment of the player identification card. The player interface may also include a credit or cash-out element for the player to collect any winnings from games played.

For game play itself, the player interfaces of gaming machines typically include a number of mechanical pushbuttons for manual activation by a player to select game preferences, activate a game sequence, or otherwise provide input to the gaming machine. The mechanical pushbuttons are typically arranged in combination on a surface of the gaming machine cabinet that is often referred to as a "button deck". Conventional button deck designs are disadvantaged in some aspects, however, and improvements are desired.

SUMMARY OF THE INVENTION

An embodiment described herein provides a slide-out gaming interface including a button deck assembly comprising a video display, a glass insulator, and a capacitive touch screen layer overlying the video display. A single piece cast flange surrounds a portion of the button deck assembly. The flange includes a front side and first and second lateral sides depending from the front side. Each of the front side and the first and second lateral sides defines an upper channel surrounding an outer periphery of the glass insulator, and each of the first and second lateral sides further includes a lower channel extending beneath the upper channel. First and second drawer slide assemblies are coupled to the respective first and second lateral sides of the flange in each lower channel.

Optionally, in a further embodiment of the slide-out gaming interface described herein, at least one of the upper channel and the lower channel may be inclined to provide drainage of a fluid spilled on the glass insulator toward a rear end of the flange. A bracket may be coupled to the glass insulator, the bracket including a rim that extends beyond a periphery of the glass insulator, and the bracket received in the upper channel to provide a degree of waterproofing to prevent a spill on a top surface of the glass insulator from damaging the video display. The flange may further include an inwardly depending anchor rib separating the upper channel and the lower channel on each of the first and second lateral sides, and the bracket may further include at least one threaded post that is self-aligning with one of the inwardly depending anchor ribs. Each respective one of the first and second drawer slide assemblies is coupled to the inwardly depending anchor rib on the first or second lateral side of the flange.

In additional further embodiments of the slide-out gaming interface described herein, the glass insulator may include at least one opening, and a mechanical pushbutton may be received in the at least one opening. The mechanical pushbutton may be mechanically isolated from the video display.

One of the button deck assembly and the flange may include at least one projection and the other of the button deck assembly and the flange may include at least one opening, with the at least one projection and the at least one opening being mated to interlock the button deck assembly and the flange. The flange may include a series of spaced apart projections on an interior surface of the front side, and the button deck assembly may include a series of spaced apart openings on a leading edge thereof and mating with the spaced apart projections to secure the button deck assembly to the flange at the front side. The slide-out gaming interface may also be provided in combination with a gaming support structure and a main video display.

Another embodiment described herein provides a manually operable push-to-release latch mechanism for a slide-out button deck assembly secured to a gaming machine by a latch element including a release lever. The latch mechanism includes a rotatable handle element coupled to the button deck assembly and being movable from a closed position to an open position on an exterior of the button deck assembly. A linearly movable link is mounted interior to the button deck assembly, and the linearly movable link including a first end and a second end, wherein the first end is displaced by a manual rotation of the rotatable handle element. A rotational link is coupled to the second end of the linearly movable link and actuates the release lever of the latch element when the linearly movable link is displaced.

Optionally, further embodiments of the latch mechanism include the linearly movable link having first and second sections extending parallel to one another, and a right angle section extending between the first and second sections. An end of the first section may include an elongated slot and the rotational link may include a pin, the pin being received in the elongated slot. The rotatable handle may be biased to the closed position. The rotatable handle element may be rotatable about a first rotational axis, and the rotational link may be rotatable about a second rotation axis, wherein the second rotational axis is perpendicular to the first rotational axis. The latch element may be an electronic rotary latch.

Another embodiment described herein provides a gaming system including a gaming support structure, a game controller, and a slide-out player interface coupled to the game support structure and operationally responsive to the game controller. The slide-out player interface includes a button deck in communication with the game controller and including video display, a glass insulator, and a capacitive touch screen layer on the glass insulator overlying the video display. A bracket is provided that includes a rim extending past an outer periphery of the glass insulator, and a flange surrounding at least a portion of the button deck. The flange is a single piece cast element formed with a front side and first and second lateral sides depending from the front side. At least the first and second lateral sides of the flange define an upper channel and a lower channel. The upper channel receiving the rim to provide a degree of waterproofing to prevent a spill on a top surface of the glass insulator from damaging the video display. First and second drawer slide assemblies are coupled to the lower channel in each respective first and second lateral side of the flange and also coupled to the gaming support structure. A latch element and a manually operable push-to-release mechanism are also provided for releasing the latch element from the gaming support structure.

Optionally, in further embodiments of the gaming system the player interface further includes at least one dynamic mechanical pushbutton that is mechanically isolated from the video display. At least one of the upper channel and the lower channel may be inclined to provide drainage of a fluid spilled on the glass insulator toward a rear end of the flange. The latch element may include a release lever, and the manually operable push-to-release mechanism latch mechanism may include a housing coupled to the flange, and a rotatable handle element being movable from a closed position to an open position on an exterior of the housing. A linearly movable link may be mounted interior to the housing, the linearly movable link including a first end and a second end, wherein the first end is displaced by a manual rotation of the rotatable handle element. A rotational link may be coupled to a second end of the linearly movable link and actuates the release lever of the latch element when the linearly movable link is displaced.

BRIEF DESCRIPTION OF THE DRAWINGS

Features and advantages of the present invention will become apparent from the following description of embodiments thereof, by way of example only, with reference to the accompanying drawings, in which.

Further aspects of the present invention will be apparent from the following description, given by way of example and with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings. Method aspects will be in part apparent from the figures and in part explicitly described in the following description.

DETAILED DESCRIPTION OF AN EMBODIMENT

Figure 1:
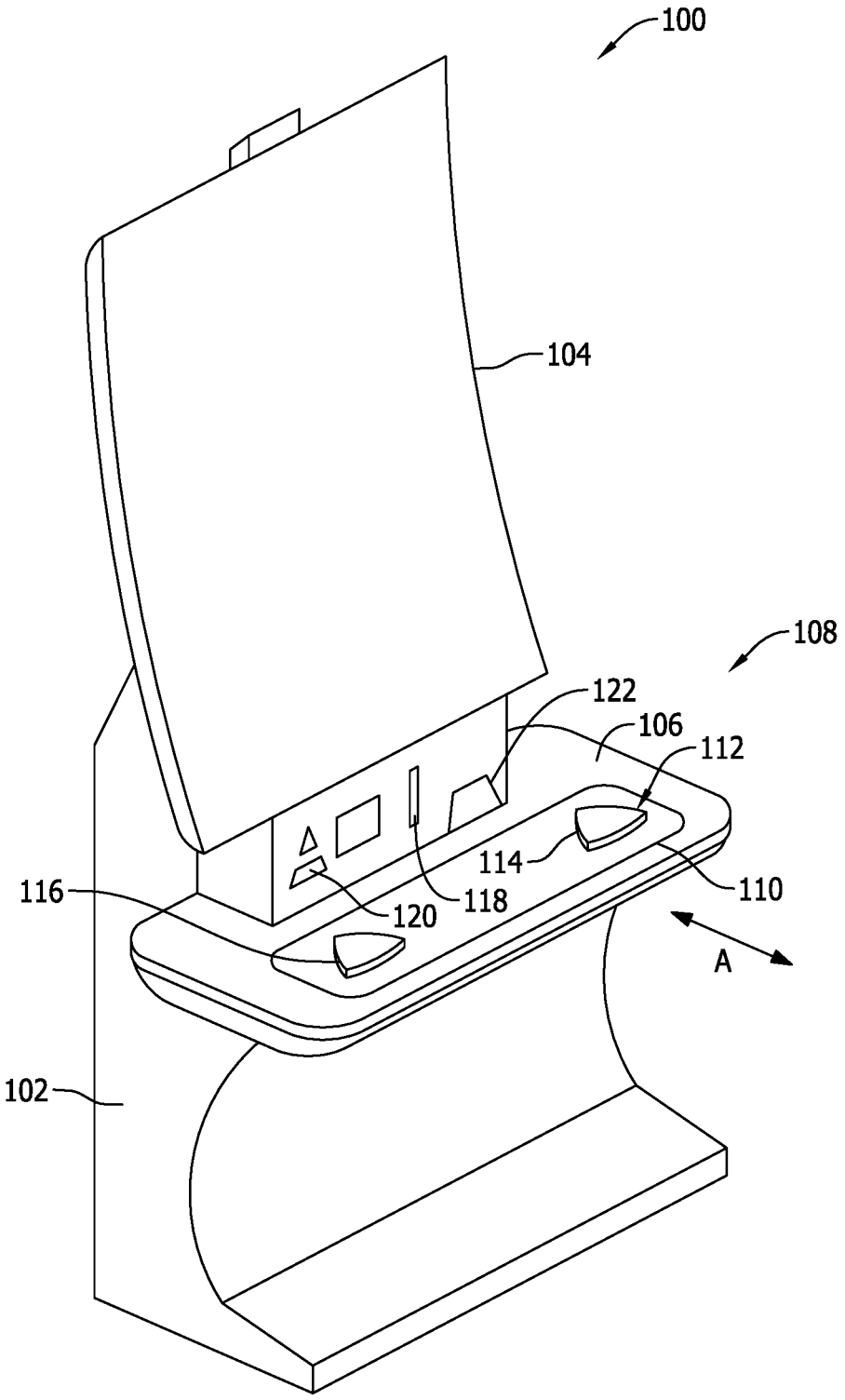
FIG. 1 is a perspective view of an exemplary embodiment of a gaming machine in accordance with an exemplary embodiment of the present invention.

FIG. 1 is a perspective view of an exemplary gaming machine 100 in accordance with an exemplary embodiment of the present invention. In one example, the gaming machine 100 is a stand-alone gaming system.

The gaming machine 100 in the example of FIG. 1 includes a console or cabinet 102 that supports a main game display 104 on which is displayed representations of a game of chance that can be played by a player. A button deck 106 is supported by the cabinet 102 below the main game display 104.

The button deck 106 defines a portion of a player interface 108 including a play interface portion 110 including a video display 112 and dynamic mechanical pushbuttons 114, 116 on the button deck 106, and a number of input/output elements including a card reader 118, a bill and/or ticket acceptor 120, and a ticket output mechanism 122 adjacent the button deck 106 and being built-in to the cabinet 102. Various different credit input mechanisms may also be employed such as, for example, a card reader for reading a smart card, debit card or credit card. A player marketing module may be provided having a reading device that may also be provided for the purpose of reading a player tracking device, for example as part of a loyalty program. The player tracking device may be in the form of a card, flash drive or any other portable storage medium capable of being read by the reading device.

The main display 104 in the example shown is a curved screen display, although it may alternatively be a flat screen. While a single main display 104 is shown, multiple displays may in combination be presented to a player. In various different embodiments, the main display 104 may be a cathode ray tube screen device, a liquid crystal display, a light emitting diode (LED) display, a plasma screen display, or any other suitable video display unit providing an appropriate picture and resolution for the game being played. Combinations of different displays of different types and or different sizes and configuration (e.g., flat or curved) may also be provided.

Figure 2:
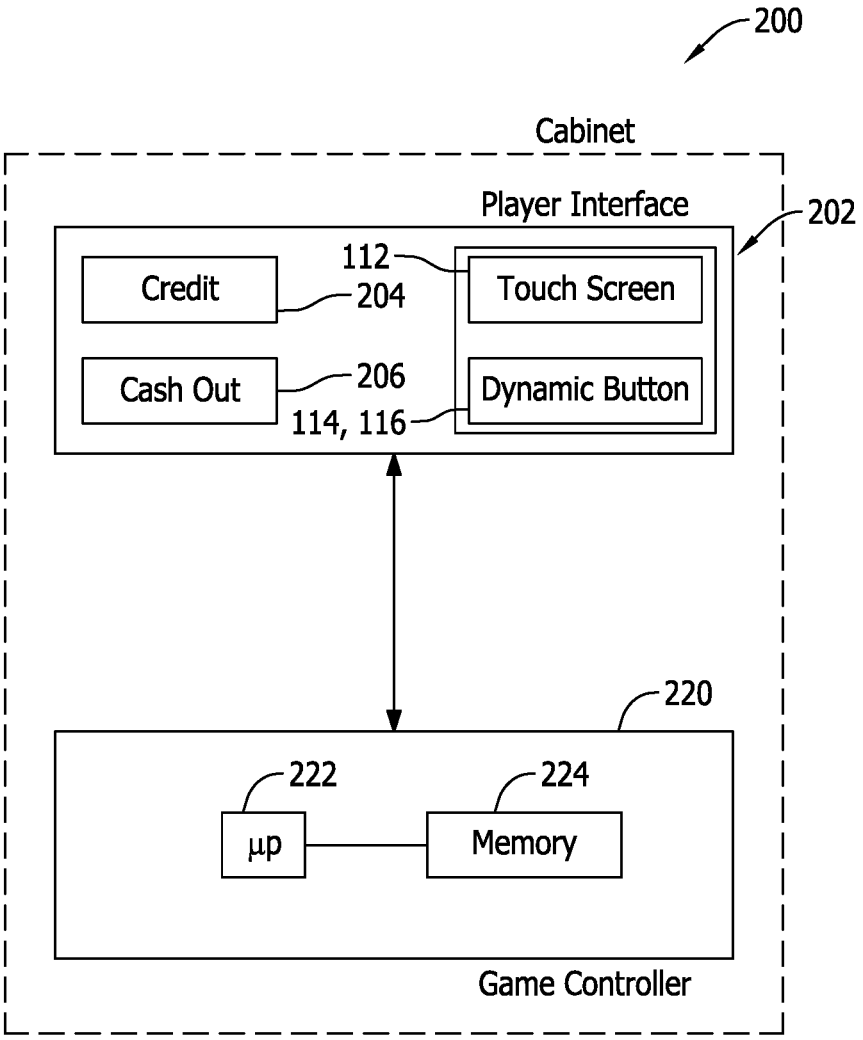
FIG. 2 is a schematic block diagram of core components of a gaming system in accordance with an exemplary embodiment of the present invention.

FIG. 2 is a schematic block diagram of core components of a gaming system 200 in accordance with an embodiment of the present invention. The gaming system 200 may be implemented in various forms.

In a first form, a standalone gaming machine such as the machine 100 is provided wherein all or most components implementing the game of chance are present in a player operable gaming machine.

In a second form, a distributed architecture is provided wherein some of the components implementing the game of chance are present in a player operable gaming machine and some of the components implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, a system architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system 200 includes several core components. At the broadest level, the core components are a player interface 202 and a game controller 220 as illustrated in FIG. 2. The player interface 202 is arranged to enable manual interaction between a player and the gaming system 200 and for this purpose includes various input/output components for the player to enter instructions and play the game.

Components of the player interface 202 may vary from embodiment to embodiment but will typically include a credit input mechanism 204 to enable a player to input credits, a cash out mechanism 206 allowing a player to receive payouts, one or more video display screens (whether touch screens or non-touch screens) such as the video display 112, and dynamic pushbuttons 114, 116 enabling a player to input game play instructions and receive outputs and feedback from the system 200. The video display 112 and pushbuttons 114, 116 may be provided in a button deck such as the button deck 106 described above and more specifically the button decks described in the embodiments below.

The game controller 220 is in data communication with the player interface 202 and typically includes a processor 222 that processes the game play instructions in accordance with game play rules and outputs game play outcomes to the displays 112 and 104. Typically, the game play instructions are stored as program code in a memory 224 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. While one controller 220 is shown, it is understood that multiple controllers may be provided in concert with one another to coordinate the functions of the various components provided.

Figure 3:
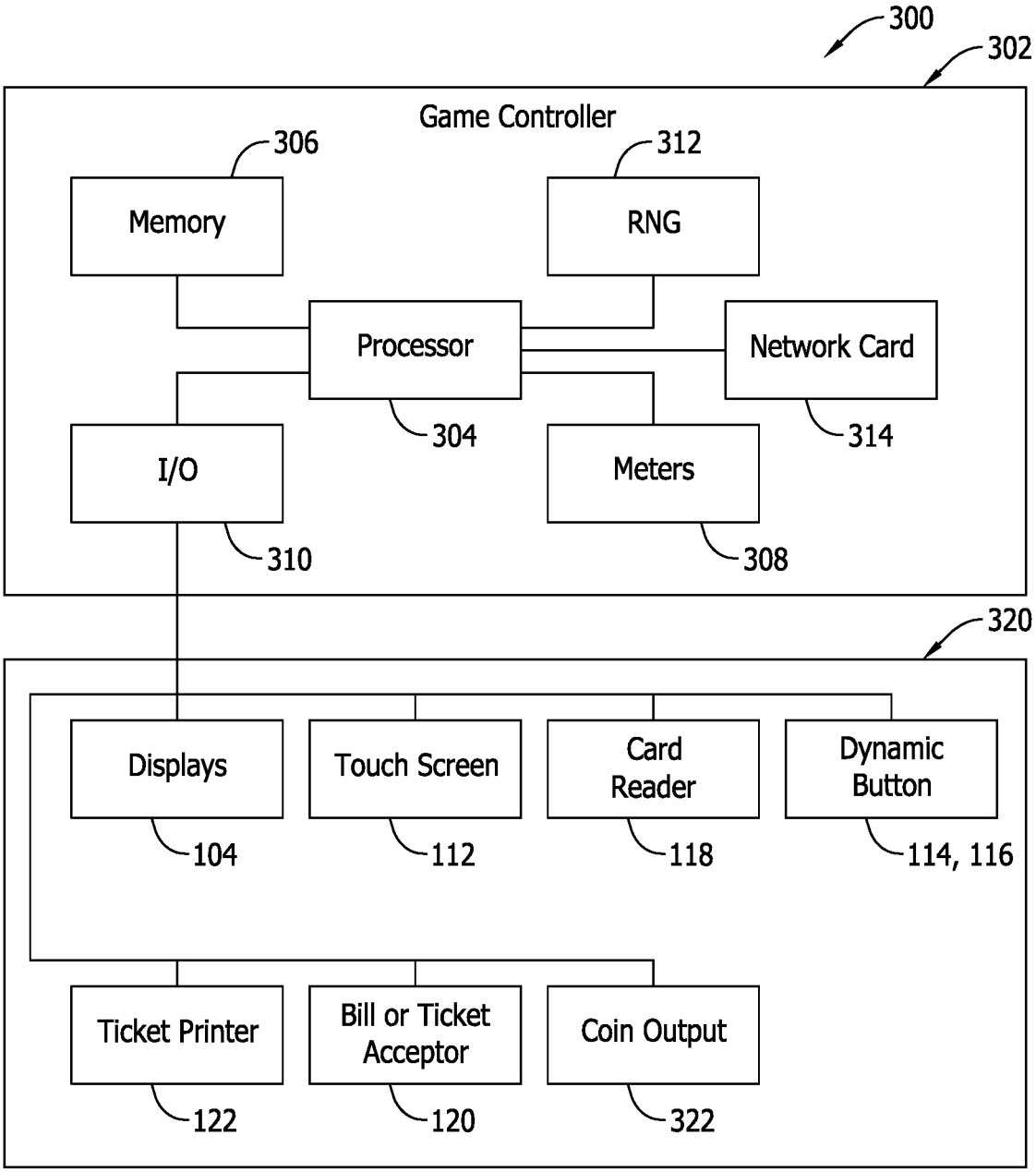
FIG. 3 is a schematic block diagram of operative components of the gaming system shown in FIG. 2.

FIG. 3 is a schematic block diagram of operative components of a gaming machine 300 including operative components of a typical gaming machine which may be the same as or different to the gaming machine 100 or the gaming system 200 (FIGS. 1 and 2).

The gaming machine 300 includes a game controller 302 having a processor 304. Instructions and data to control operation of the processor 304 are stored in a memory 306, which is in data communication with the processor 304. Typically, the gaming machine 300 will include both volatile and non-volatile memory and more than one of each type of memory, with such memories being collectively represented by the memory 306.

The gaming machine 300 may have software and hardware meters 308 for purposes including ensuring regulatory compliance and monitoring player credit and an input/output (I/O) interface 310 for communicating with peripheral devices of the gaming machine 300. The input/output interface 310 and/or the peripheral devices may be intelligent devices with their own memory for storing associated instructions and data for use with the input/output interface or the peripheral devices. A random number generator module 312 generates random numbers for use by the processor 304. Persons skilled in the art will appreciate that the reference to random numbers includes pseudo-random numbers.

In addition, the gaming machine 300 may include a communications interface, for example a network card 314. The network card may, for example, send status information, accounting information or other information to a central controller, server or database and receive data or commands from a central controller, server or database.

In the example shown in FIG. 3, a player interface 320 includes peripheral devices that communicate with the game controller 302. Such devices include one or more main game displays 104, an interface display 112 and/or dynamic pushbuttons 114, 116 (provided in the form of the button deck 106 shown in FIG. 1), a card reader 118, a coin, bill and/or ticket acceptor 120, a ticket printer 122, and a coin output mechanism 322. Additional hardware may be included as part of the gaming machine 300, or hardware may be omitted based on the specific implementation. The hardware may be mounted to a cabinet, console or other support structure in a desired game machine configuration.

Figure 4:
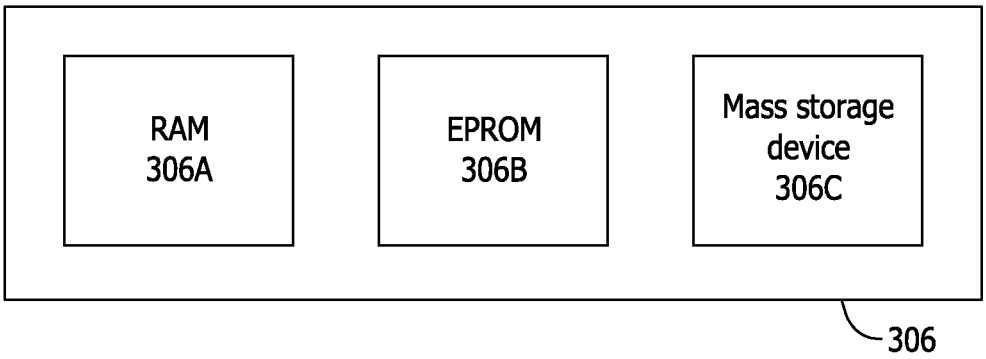
FIG. 4 is a schematic block diagram of components of a memory of the gaming system shown in FIG. 3.

FIG. 4 shows a block diagram of the main components of an exemplary memory 306. The memory 306 includes RAM 306A, EPROM 306B and a mass storage device 306C. The RAM 306A typically temporarily holds program files for execution by the processor 304 and related data. The EPROM 306B may be a boot ROM device and/or may contain some system or game related code. The mass storage device 306C is typically used to store game programs, the integrity of which may be verified and/or authenticated by the processor 304 using protected code from the EPROM 306B or elsewhere.

It is also possible for the operative components of the gaming machine 300 to be distributed, with the example input/output devices in the player interface 320 to be provided remotely from the game controller 302. It is also possible for the controller 302 to communicate with player interfaces 320 of multiple and different gaming machines.

Figure 5:
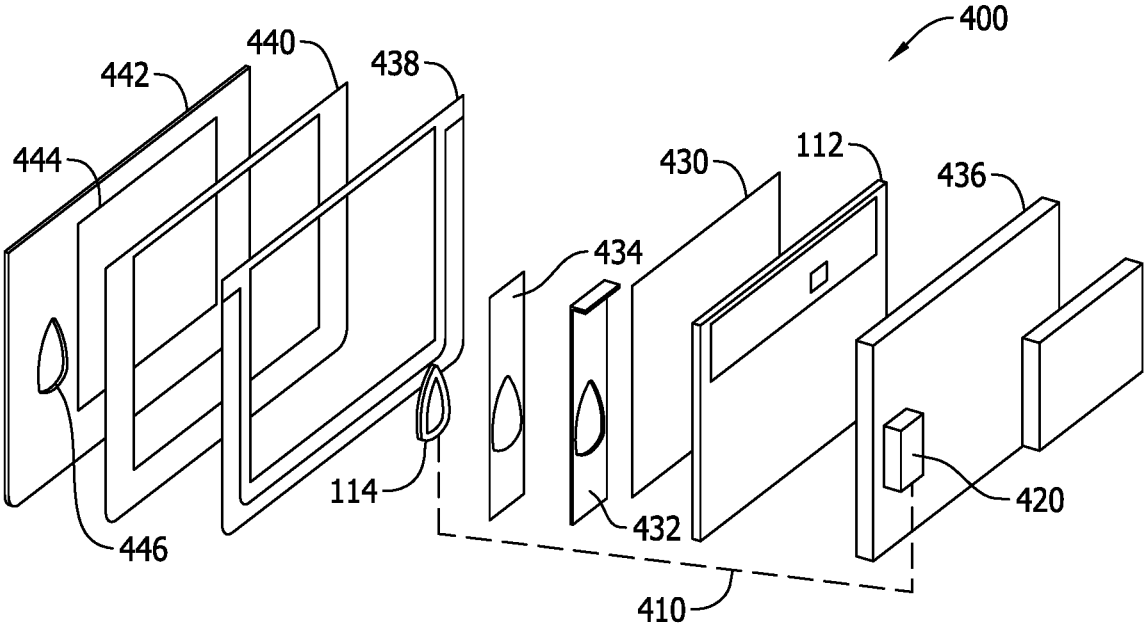
FIG. 5 is an exploded view of an embodiment of a player interface for a gaming machine.

As shown in FIG. 5 in exploded view, a button deck assembly 400 is shown that may be implemented as the button deck 106 in the player interface 108 of the gaming machine 100 (FIG. 1) or in the other player interfaces of the machines and systems described above.

The button deck assembly 400 includes video display 112 that may be used, for example, as part of the player interface 108, 202, 320 in the gaming machines and gaming systems described above. The video display 112 may be a liquid crystal display (LCD). Alternatively, another type of display video display such as cathode ray tube screen device, a light emitting diode (LED) display, an active-matrix organic light-emitting diode (AMOLED) display, a plasma screen display, a cathode ray tube screen device, or any other suitable video display unit providing an appropriate picture and resolution for the game being played.

As seen in FIG. 5, the video display 112 is provided with a spacer element 430 provided on its front side and a support plate or bracket 432 that clips to the housing of the video display 112.

The support plate or bracket 432 includes an opening as shown that receives the mechanical pushbutton 114, which may be mounted thereto with fasteners in a spaced or gapped relation to a front surface of the video display 112 on the front side as shown. As such, the pushbutton 114 that is mounted to the bracket 432 floats over the top surface or front surface of the display 112 while being mechanically isolated from the video display 112 via the support plate 432. An optional gasket 434 may be provided to waterproof the assembly, and a wire 410 may extend on the surface of the gasket 434, around the lower edge of the bracket 432 and the display 112 and then extend to a video controller 420 provided on the rear side of the video display 112 with the control circuitry 436 of the video display 112 that is implemented in various circuit boards. The wire 410 may be a flexible transparent wire that is not easily seen, if at all, under a glass insulator 442 that is provided over the top of the gasket 434 and the button bracket 432.

A glass bracket 438 is also provided on the front side of the video display 112 and is attached to a housing or frame of the video display 112. Double sided tape 440 is applied to the front side of the glass bracket 438, and the glass insulator 442 including a capacitive touch screen layer 444 is adhered to the double sided tape 440 as shown in FIG. 5. The capacitive touch screen layer 444 may be a transparent conductor such as indium tin oxide (ITO). In another embodiment, another touch sensitive element may be provided to realize a surface capacitive touchscreen or a projective capacitor touchscreen. Briefly, a surface capacitive touchscreen includes sensors at the corners of the screen and a thin evenly distributed film across the surface of the layer 444, whereas a projective capacitive touchscreen uses a grid of rows and columns on the layer 444 with a separate chip for sensing. Capacitive touch screen technology is otherwise known and not described further herein.

An opening 446 is shown in the glass insulator 442 and is fitted over the mechanical pushbutton 114 to provide a low profile player interface including the pushbutton 114. The opening 446 is complementary in shape with the outer profile of the pushbutton 114. The mechanical pushbutton 114 is received in and occupies nearly an entirety of the opening 446, with only a slight gap between the outer profile of the pushbutton and the inner periphery of the opening 446.

In contrast with a conventional, static pushbutton having a fixed appearance, the pushbutton 114 is a dynamic pushbutton having practically any appearance desired depending on electronic configuration of the interface by the game controller. Specifically, the pushbutton 114 has a transparent or see-through surface that allows a portion of the video display 112 to be seen through the pushbutton 114. The appearance of the pushbutton 114 may therefore be electronically changed via changing the graphics, colors, videos or animations in the video display 112 beneath the pushbutton 114 to accommodate different games, may be electronically changed via the video display 112 to have a different appearance at different times in the same game, and may also serve different functions in the same game or different games via electronic reconfiguration of the video display 112 in and around the area in the interface occupied by the pushbutton 114.

Various different play interfaces for the same or different games are possible via the display 112, the touch screen layer 444, and the pushbutton 114. As such, the button deck 400 is highly reconfigurable to provide different play interfaces that are visually and functionally distinct from one another to accommodate different games while otherwise using the same hardware in the button deck 400. The same button deck 400 can therefore be more or less universally used on different gaming machines and in different gaming systems to play different games, or the same button deck 400 can facilitate presentation and play of multiple and different games on the same gaming machine or system.

Advantageously, and generally unlike static pushbuttons in a conventional button deck, the dynamic pushbutton 114 can serve more than one function in the same game or different functions in different games. That is, the pushbutton 114 can clearly be designated or re-designated (i.e., configured and re-configured) with clear prompts to the player to use the pushbutton 114 for different purposes as desired. Such prompts to the player may be provided on the display 112 in the button deck 400, or another display such as the main display 104 shown in FIG. 1.

Also advantageously, a player interface can electronically be configured on the button deck 400 to present a practically unlimited number of graphic themes and color schemes to provide substantially different game impressions and game experiences. As opposed to conventional button decks that are custom designed for a specific game, substantial cost savings in providing game machines and introducing new games is beneficially provided by the electronically reconfigurable button deck 400.

To further enhance the interface, the dynamic pushbutton 114 may also include a lighting element (e.g., a light emitting diode (LED) element) to provide further distinctive visual effects. In one example, the pushbutton 114 may include a multicolor red, green blue (RGB) Halo lighting element extending around the entire perimeter to provide accent lighting to the pushbutton 114 in one of a plurality of different colors, providing for even further variability in the appearance of the pushbutton 114. Additionally, the lighting element 130 may be brightened or dimmed, turned on and off, or change colors to signify different features or accentuate different aspects of a game in progress. Blinking and chasing light effects may also be implemented. Unique visual impressions to observers and potential players may draw interest to the gaming machine, apart from any visual impression of the video display 112 being visible through the pushbutton 114. While the lighting element may enhance the dynamic appearance of the pushbutton 114, it may in some instances be considered optional and need not be provided when the video display 112 provides sufficient brightness to meet the needs of a particular game application.

The versatility and benefits of the reconfigurable button deck 400 including the dynamic pushbutton 114 is further described in U.S. patent application Ser. No. 15/686,688 incorporated by reference herein, including exemplary game play interface and display processes, control algorithms, game play options and functionality, and player interaction. In certain embodiments contemplated, however, the pushbutton 114 in some embodiments need not be dynamic at all, and instead of being transparent it may be painted or provided with a label, for example, to impart a fixed, static appearance.

While one pushbutton 114 is shown in FIG. 5, a second pushbutton 116 may be included by providing additional bracket 432 and an additional opening in the glass insulator 442 to provide the interface 110 shown in FIG. 1 including the two pushbuttons 114 and 116. Numerous variations of player interfaces are possible in this regard including different numbers of pushbuttons located in different relative positions in the interface. Additionally, more than one pushbutton could be mounted to the same bracket, and pushbuttons of different sizes and shapes may be incorporated in player interfaces as desired. Combinations of dynamic and static pushbuttons are likewise possible in the same player interface.

FIGS. 6 through 17 illustrate aspects of a button deck assembly 500 similar to the button deck 400 but integrated in a slide-out assembly that can be attached to a cabinet of a gaming machine, such as the cabinet 102 shown in FIG. 1. The button deck assembly 500 can be used in the machine 100 shown in FIG. 1 in lieu of the button deck 106 in the player interface 108.

Figure 6:
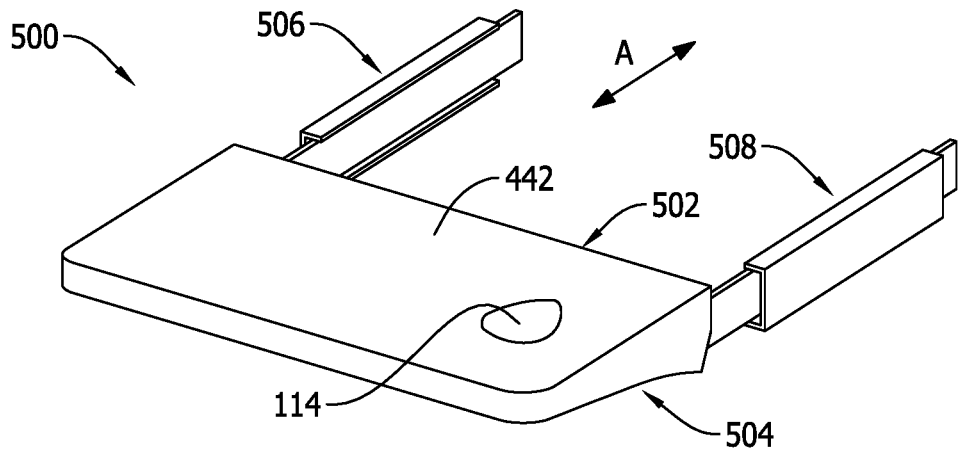
FIG. 6 is a first top perspective view of a slide-out button deck assembly for a gaming machine and system as shown in FIGS. 1-5.
Figure 7:
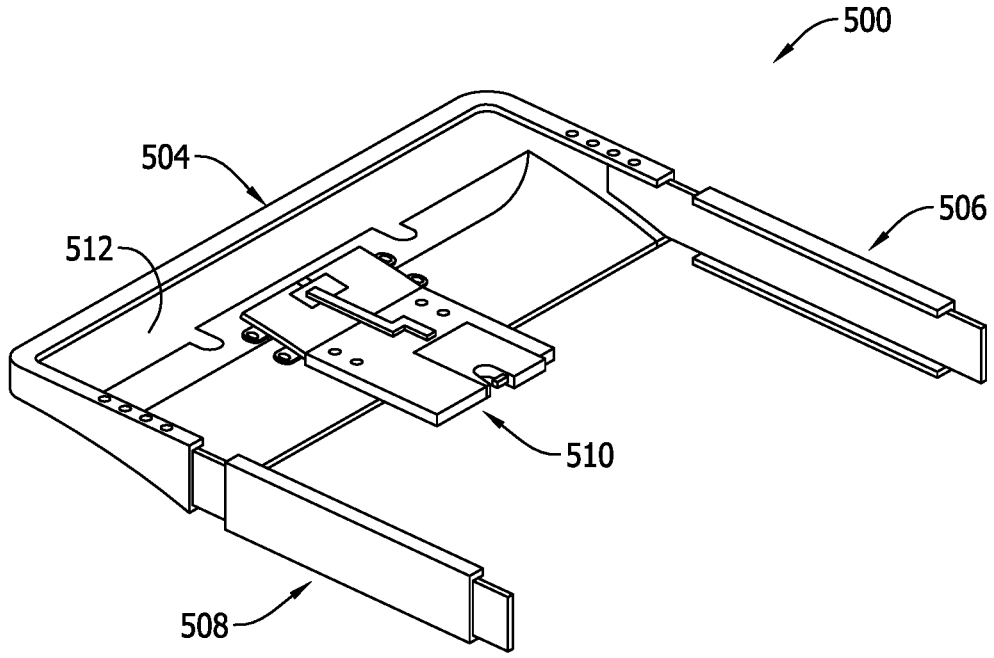
FIG. 7 is a second top perspective view of the slide-out button deck assembly shown in FIG. 6.

The button deck assembly 500 includes, as a shown in top perspective view in FIG. 6, a button deck 502 including the glass insulator 442 overlying the video display 112 (FIG. 5) and the pushbutton 114. The button deck 502 is slidably received in a flange 504 that is, in turn, attached to drawer slide assemblies 506 and 508 that may be fastened in part to a cabinet such as the machine cabinet 102 or other gaming support structure such as a pedestal. Each drawer slide assembly 506, 508 includes a first rail section that is mounted stationary to the machine cabinet 102 or other support structure as desired, and a second rail section that is slidably movable on and relative to the first rail section. As such, the button deck 502 and the flange 504 may be moved on the drawer slide assemblies 506, 508 relative to the cabinet 102 toward and away from the cabinet 102 as shown in the direction of arrow A to selectively extend or retract the button deck 502 relative to the cabinet 102 or other support structure. In the retracted position as shown in FIGS. 6 and 7, the button deck 502 is positioned for game play, while in the extended position the button deck 502, via operation of the drawer slide assemblies 506 and 508, is moved away from the cabinet 102 creating a space to access an interior of the cabinet for service of elements such as the card reader 118, the bill and/or ticket acceptor 120 (FIGS. 1 and 3) or coin input mechanism 322 (FIG. 3), and the ticket output mechanism 122 (FIGS. 1 and 3). If desired, the button deck 502 can also easily be removed for service once the drawer slide assemblies are extended, or replaced with another button deck 502 of the same or different configuration.

FIG. 7 shows the assembly 500 in perspective view with the button deck 502 removed. A latch mechanism 510 is seen in FIG. 7 that underlies the button deck 502 (FIG. 6). The latch mechanism 510 is operable by a user to latch or lock the button deck assembly 500 in the retracted position relative to the cabinet 102 to ensure that is securely attached and cannot be moved, or to unlatch or release the button deck assembly 500 for movement relative to the cabinet 102 to the extended position. The structure and operation of the latch mechanism 510 is described further below in relation to FIGS. 18-20.

Figure 8:
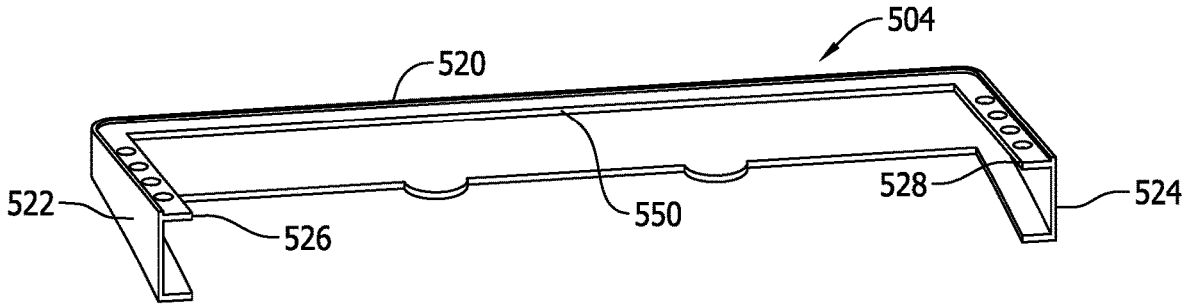
FIG. 8 is a first rear perspective view of a flange for the slide-out button deck assembly shown in FIG. 6.
Figure 9:
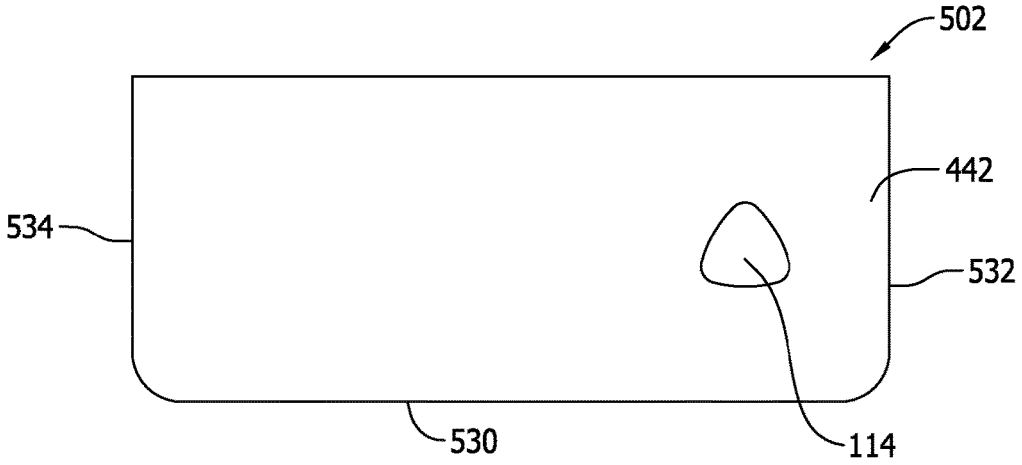
FIG. 9 is a top view of the slide-out button deck assembly with the flange shown in FIG. 8 removed.

As shown in the rear perspective view of FIG. 8, the flange 504 is formed and fabricated as a single piece from a suitable material such as aluminum according to a casting process using known techniques. The single piece flange 504 is formed to include a front longitudinal side 520 and lateral sides 522, 524 extending generally perpendicular from each opposing end of the front side 520. As such, the flange 504 including the sides 520, 522, 524 is generally U-shaped, and receives the respective longitudinal front edge 530 and the lateral side edges 532, 534 of the button deck 502 as shown in FIG. 9. The flange lateral sides 522, 524 include a curved lower edge as shown, although alternative shapes and geometries are possible. Likewise, the flange front side 520 is shown as being substantially flat and slightly angled toward the rear, although alternative shapes and geometries are possible here as well. The flange 504 is shown in FIG. 7 to include a lower curved wall 512 that joins the front side 520 and the lateral sides 522, 524, although alternative shapes and geometries are possible. The relatively complex shape of the flange 504 is facilitated by casting the flange in a single piece, although simpler shapes are of course possible in alternative embodiments. The single piece flange 504 reduces a parts count in the manufacture of the button deck assembly 500 and also simplifies assembly as described below.

Figure 10A:
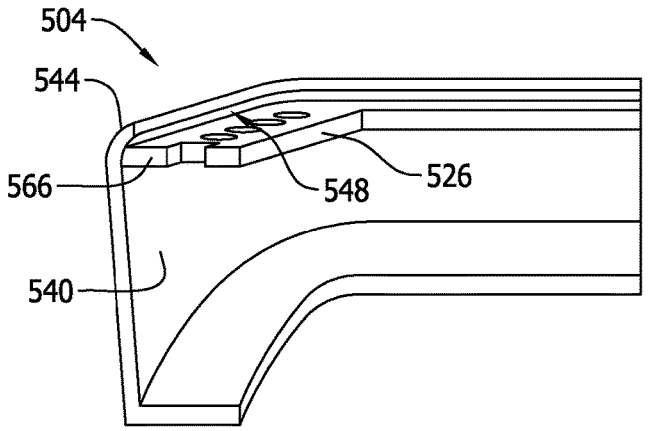
FIG. 10A is magnified view of a portion of FIG. 10.
Figure 10:
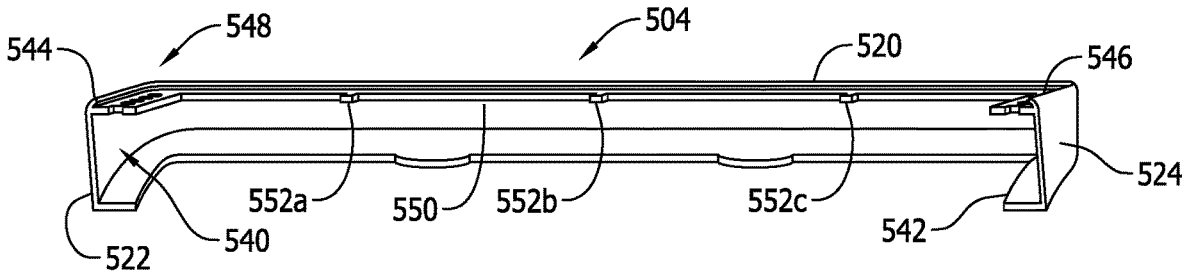
FIG. 10 is a second rear perspective view of the flange for the slide-out button deck assembly shown in FIG. 6.

As seen in FIGS. 8, 10, and 10A each of the lateral sides 522, 524 of the flange 504 includes an inwardly depending anchor rib 526, 528 including a series of spaced fastener openings that may receive fasteners to attach a rail section in each respective one of the drawer slide assemblies 506, 508 to the flange 504. Beneath each anchor rib 526, 528 is a channel 540, 542 that receives a portion of the drawer slide assemblies 506 and 508 in each lateral side 522, 524. Above each anchor rib 526, 528 is an inwardly depending distal end 544, 546 on each lateral side 522, 524 that defines a second channel 548 (FIG. 10A) that receives a portion of the button deck 502 and surrounds a periphery of the glass insulator 442. The front side 520 of the flange 504 is likewise formed with a rib 550 that is coplanar with the anchor ribs 526, 528 and the distal end of the front side 520 depends inwardly to define a continuation of the channel 548 across the front side 520 between the anchor ribs 526, 528.

Figure 11:
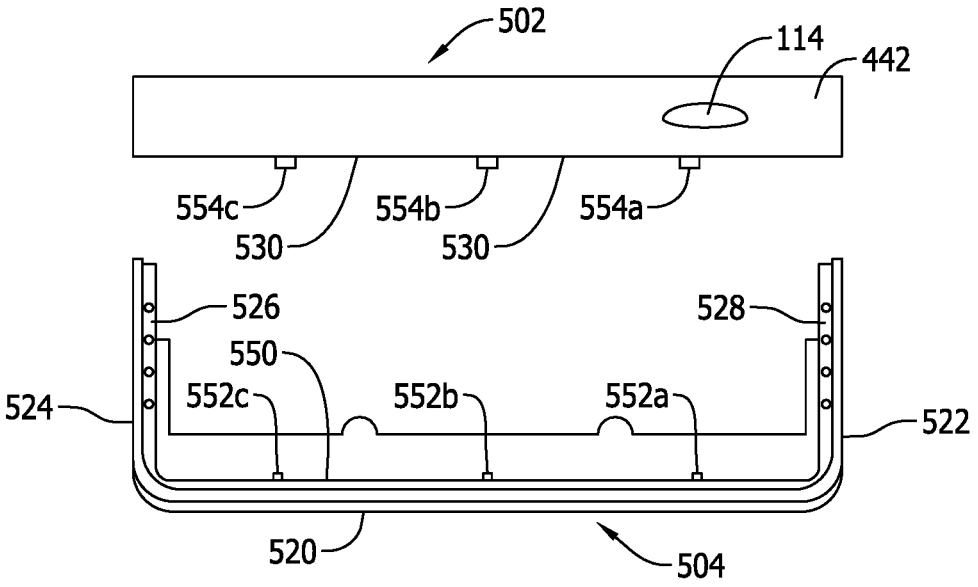
FIG. 11 illustrates mating features of the button deck and flange in the slide-out button deck assembly shown in FIG. 6.

As seen in FIG. 10, the interior face of the flange front side 520 includes a series of spaced-apart projections 552*a*, 552*b*, 552*c* extending in a generally aligned and coplanar manner to one another adjacent the rib 550. The button deck 502 likewise includes a series of spaced-apart openings 554*a*, 554*b*, 554*c* depending on a leading edge thereof proximate the front side 530 of the glass insulator 442 as seen in FIG. 11. The projections 552*a*, 552*b*, 552*c* and the openings 554*a*, 554*b*, 554*c* respectively mate in an interlocking fashion with one another to secure the button deck 502 to the flange 504 at the front side 520.

Figure 12:
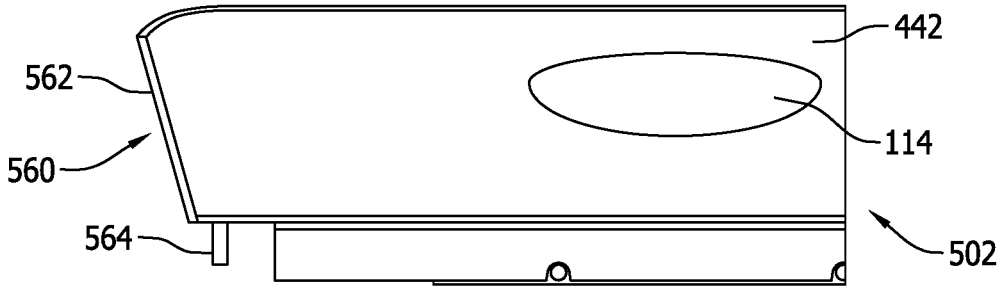
FIG. 12 is a partial rear end perspective view of a portion of the slide-out button deck assembly shown in FIG. 6.

As seen in FIG. 12, in the illustrated example the button deck 502 includes a bracket 560 having a rim 562 extending just past the outer periphery of the glass insulator 442, and when the rim 562 is received in the channel 548 formed in the flange 504 a top surface of the glass insulator 442 is substantially flush with the top of the flange 504 with only a small gap between the outer periphery of the glass insulator 442 and the adjacent distal ends of the flange 504. Considering that the glass insulator 442 is one piece and the flange 504 is a single piece cast element, the assembly 500 provides a clean appearance without part lines that are visible as in many conventional button deck assemblies.

Advantageously, the rim 562 extending in the channel 548 adjacent the outer periphery of the glass insulator 442 provides a degree of waterproofing to the assembly 500. Any fluid spilled on the top surface of the glass insulator 442 will be generally prevented from passing through to the other side of the glass insulator where it could damage the video display 112 or other electronic elements. On this note, the drawer slide assemblies 506, 508 may be slightly inclined to ensure that any fluid that reaches the channel 548 flows toward the rear on the rim 562 or adjacent the rim 562 in the channel 548 to the rear end of the flange 504 where it can drain at a location away from sensitive electronics. Likewise, the drawer slide assemblies 506, 508 could be mounted level with the channel 548 in the flange being slightly inclined to provide a fluid drainage feature. Gaskets or additional sealants or waterproofing features may also be included as desired or as needed to provide further protection to any sensitive electronics from spills on the surface of the glass insulator 442.

Figure 16:
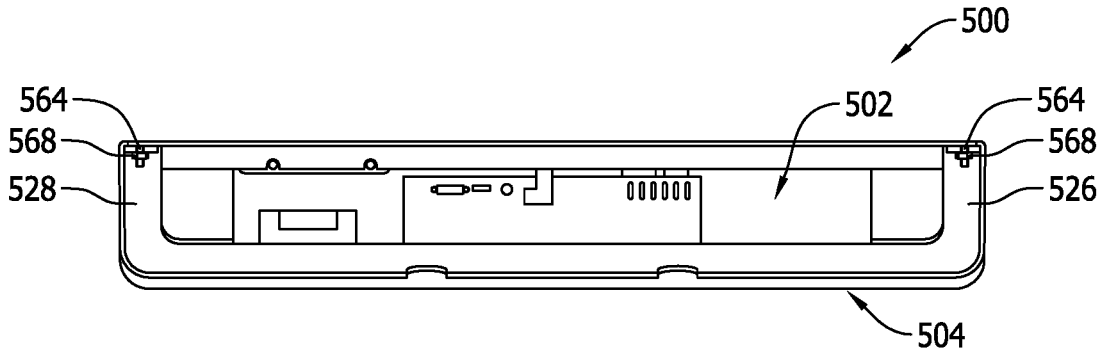
FIG. 16 is a fourth assembly view of the slide-out button deck assembly shown in FIG. 6 at a fourth stage of manufacture.
Figure 17:
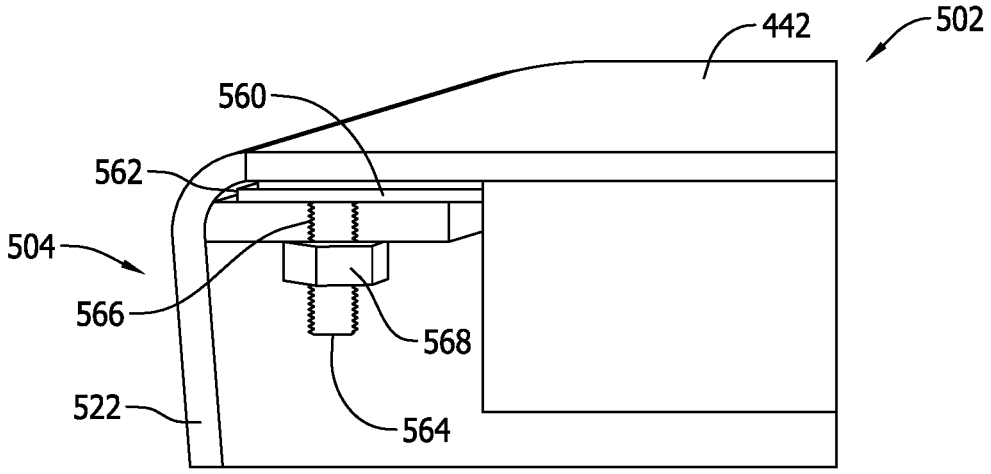
FIG. 17 is a partial rear perspective view of the slide-out button deck assembly shown in FIG. 16 at the fourth stage of manufacture.

As also shown in FIGS. 12, 16 and 17, the bracket 560 further includes a threaded post 564 that slides into an aperture 566 (FIG. 10A) in the end of each anchor rib 526, 528 in the flange 504. Once the post 564 is mated in the aperture 566, the bracket 564 may be fastened to the flange 504 with a nut 568 to each of the anchor ribs 526, 528. The posts 564 are easily accessible from the rear side as shown in FIGS. 16 and 17. Rail sections of the drawer slide assemblies 506 and 508 may be attached to each side 522, 524 the flange 504 before or after the button deck 502 is attached.

FIGS. 13-17 illustrate respectively different manufacturing and assembly stages of the button deck assembly 500 including the button deck 502 having the bracket 560 for mating engagement with the flange 504. The button deck 502 is provided as a sub-assembly for attachment to the flange 504 and drawer slide assemblies 506 and 508.

Figure 13:
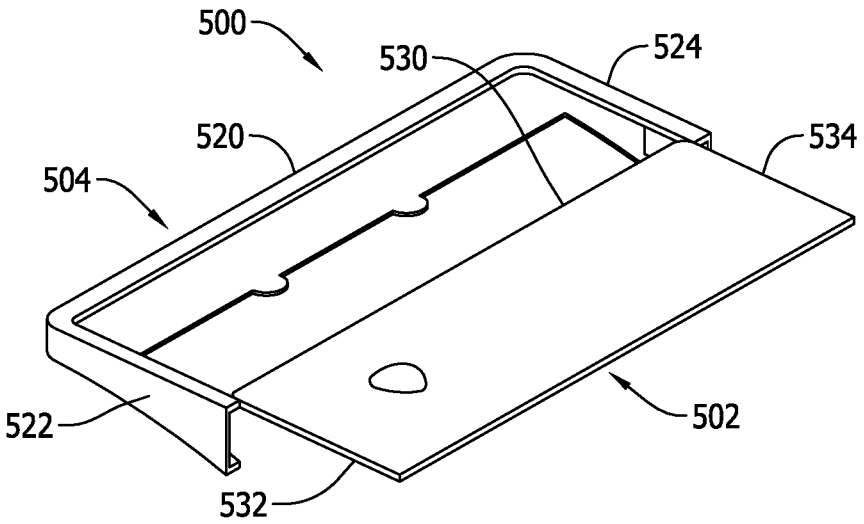
FIG. 13 is a first assembly view of the slide-out button deck assembly shown in FIG. 6 at a first stage of manufacture.

FIG. 13 shows the button deck 502 being aligned with the cast flange 504 such that the button deck sides 532, 534 (and specifically the sides of the bracket rim 562) can be slidably received in the flange channel 548 (FIG. 10A) at the distal ends of the flange sides 522, 524 at the rear side of the flange 504.

Figure 14:
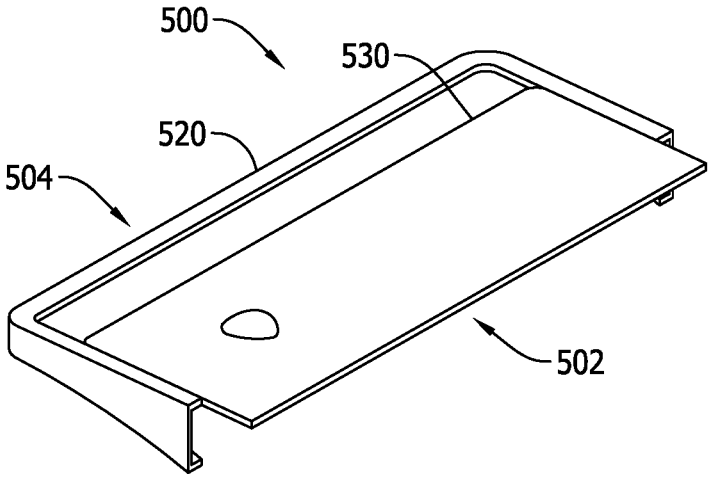
FIG. 14 is a second assembly view of the slide-out button deck assembly shown in FIG. 6 at a second stage of manufacture.

FIG. 14 shows the button deck 502 (and specifically the sides of the bracket rim 562) being slidably advanced in the flange channel 548 in the flange sides 522, 524 toward the flange front side 520. As such, the front edge 530 of the button deck 504 is moved closer to the flange front side 520.

Figure 15:
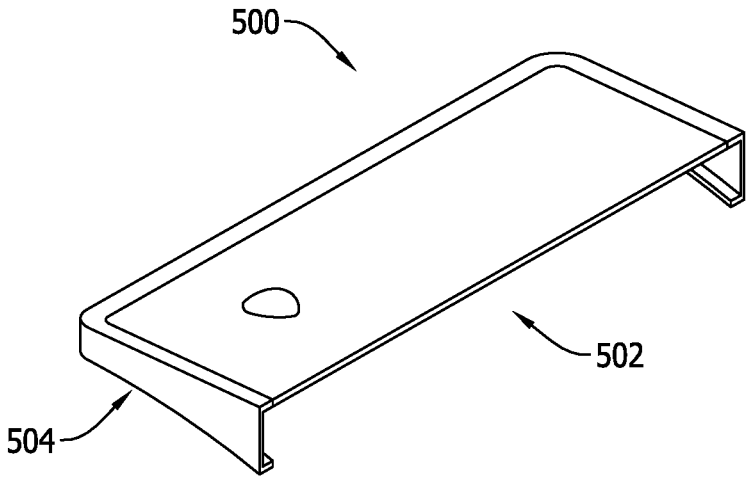
FIG. 15 is a third assembly view of the slide-out button deck assembly shown in FIG. 6 at a third stage of manufacture.

FIG. 15 shows the button deck 502 (and specifically the sides of the bracket rim 562) being further advanced in the flange channel 548 in the flange sides 522, 524 to a final position wherein the flange projections 552*a*, 552*b*, 552*c* (FIG. 11) and the button deck openings 554*a*, 554*b*, 554*c* (FIG. 11) are mated and interlocked. The button deck 502 and the flange 504 are now mechanically coupled at the flange front side 520 and the button deck side 530.

As shown in FIGS. 16 and 17, as the flange projections 552*a*, 552*b*, 552*c* (FIG. 11) and the button deck openings 554*a*, 554*b*, 554*c* (FIG. 11) are mated and interlocked, the threaded bracket posts 564 are simultaneously received in the apertures 566 (FIG. 10A) in each of the anchor ribs 526, 528 in the flange sides 522, 524. Fasteners such as nuts 568 are coupled to the threaded posts 564 to mechanically couple the button deck 502 to the anchor ribs 526, 528 in the flange 504 at the rear side as shown. The threaded posts 564 are self-aligning with the apertures 566 in the assembly, allowing the nuts 568 to be installed with relative ease. Once the nuts 568 are tightened, the button deck 502 and the flange 504 are securely attached at the front and rear sides, and are accordingly slidable as a unit via the drawer slide assemblies 506, 508 when respective rail sections of the assemblies 506, 508 are attached to the cabinet 102 (FIG. 1) or other support structure.

Figure 18:
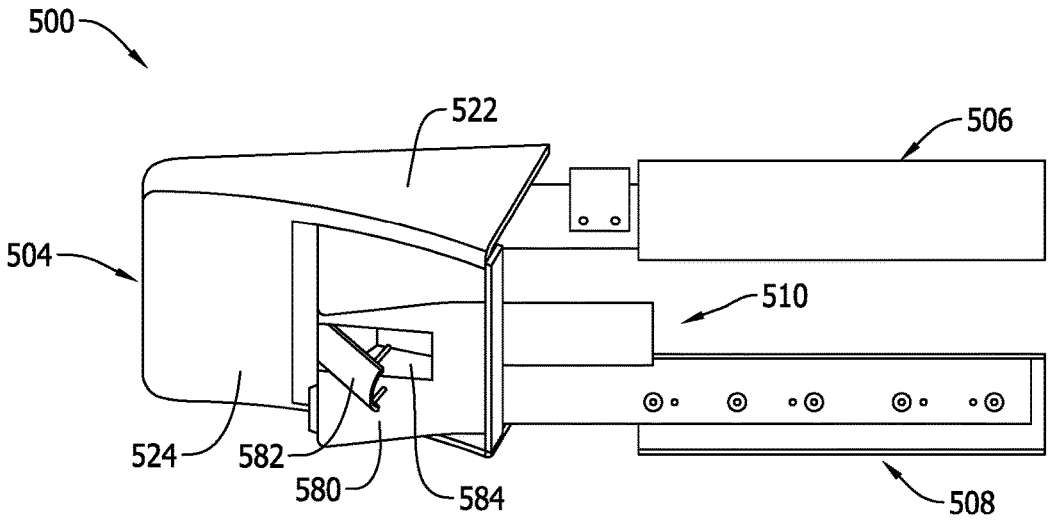
FIG. 18 is a bottom perspective view of the slide-out button deck assembly shown in FIG. 6 illustrating a first manual actuation linkage of a push-to-release latching mechanism.

FIG. 18 is a bottom perspective view of the slide-out button deck assembly 500 illustrating a manual actuation linkage of a latch mechanism 510 (also shown in FIG. 7). In FIG. 18, the slide-out button deck assembly 500 is shown in the retracted position wherein the latch assembly 510 may be interlocked with a fixed locking feature (not shown) that is located inside the cabinet 102 (FIG. 1). When so interlocked, the slide-out button deck assembly 500 is secured and fixed in position relative to the cabinet 102 and accordingly prevents the button deck assembly 500 from moving relative to the cabinet 102. The drawer slide assemblies 506, 508 are prevented from moving to the extended position with the latch mechanism 510 locked.

As seen in FIG. 18, a housing piece 580 is attached to the lower side of the flange 504, and a latch actuation handle 582 is mounted to the housing piece 580 in a generally elongated opening 584 therein. The opening 584 is centrally located between the lateral sides 522, 524 of the flange in the example shown. In another embodiment, however, the opening 584 and the latch actuation handle 582 could be off-centered relative to the housing piece 580.

The latch actuation handle 582 is rotatable relative to the housing piece 580 within the opening 584, and as shown in FIG. 18 has been rotated to an open position. The location of the latch actuation handle 582 may be easily and intuitively detected by hand, however, when a person feels the underside of the housing piece 580. Once the latch actuation handle 582 is felt, the user may move the distal end of the latch actuation handle 582 with his or finger to rotate the latch actuation handle 582 and release the latch mechanism. The latch actuation handle 580 is spring-loaded and returns to a closed position when released. That is, the latch actuation handle 582 is biased with sufficient force to a closed position to maintain its closed position, with the bias force being easily overcome by the user to open the latch actuation handle 582 when desired. Stop features are also built-into the latch actuation handle 582 and/or housing piece to prevent over-rotation of the latch actuation handle 582.

In the open position shown, the latch actuation handle 582 extends obliquely to both the outer surface of the housing piece 580 and the outer surface of the lower side of the flange 504. In the closed position the latch actuation handle 582 is substantially flush with the outer surface of the housing piece 580. In the example shown, the latch actuation handle 582 is arcuate at its distal end and slightly protrudes from the outer surface of the housing piece 580 providing a lip that can be felt and actuated with a person's finger to open the handle 582. The housing piece 580 and the latch actuation handle 582 may be cast parts fabricated from suitable materials (e.g., plastic) using known processes. While exemplary shapes and geometries of the housing piece 580 and the latch actuation handle 582 are shown in the Figures, other shapes and geometries are possible in alternative embodiments as desired.

Figure 19:
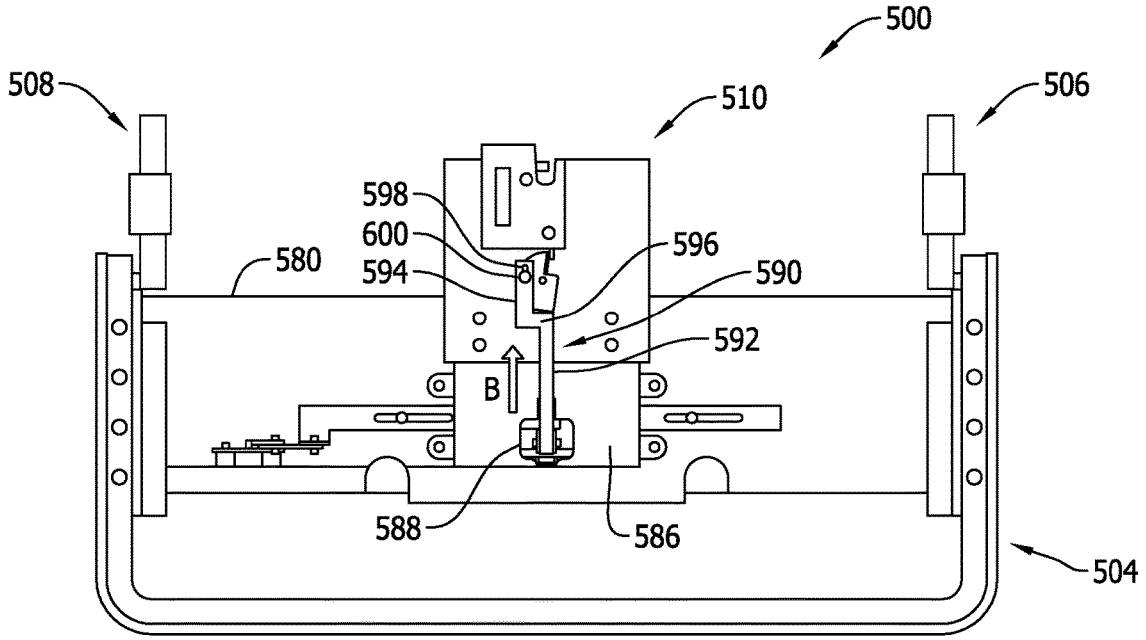
FIG. 19 is a top view of the slide-out button deck assembly illustrating a second manual actuation linkage of the push-to-release latching mechanism.
Figure 20:
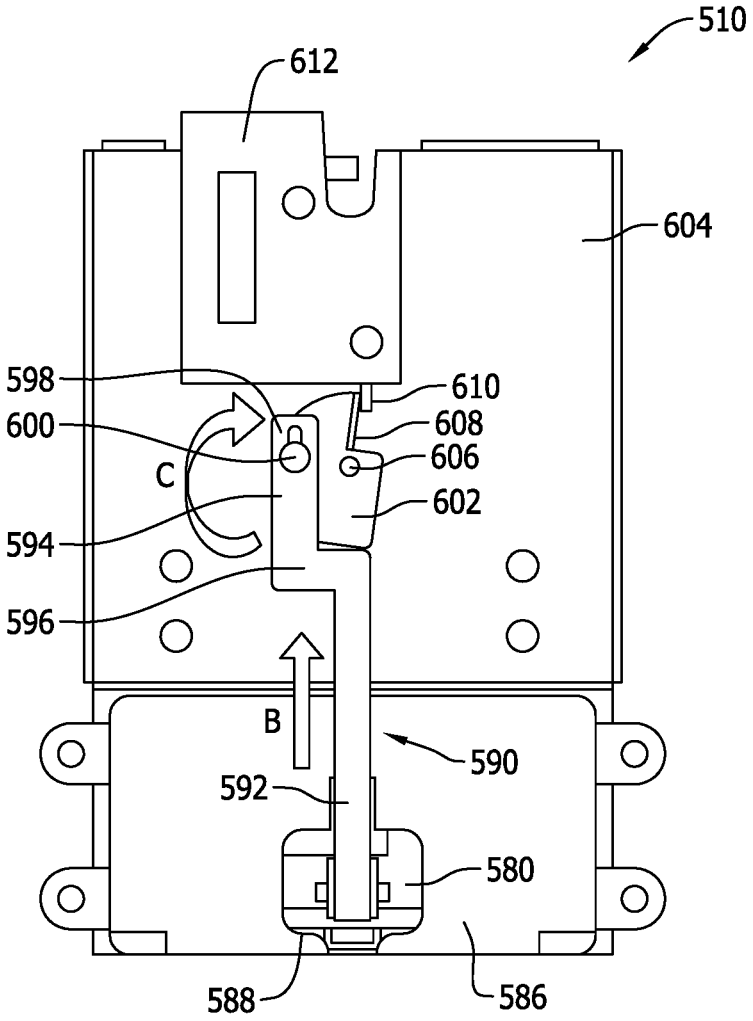
FIG. 20 is a top view of a portion of FIG. 19 illustrating an unlatching of the push-to-release mechanism via the manual actuation linkage shown in FIGS. 18 and 19.

FIG. 19 is a top view of the slide-out button deck assembly 502 illustrating the latch mechanism 510 from above, and FIG. 20 is an enlargement of a portion of FIG. 19. The latch mechanism 510 is shown to include a housing piece 586 attached to the housing piece 580. Housing piece 586 includes an opening 590 formed therein proximate the end of the latch actuation handle 582. As the latch actuation handle 582 is rotated to the open position, the end of the latch actuation handle 582 displaces a first end of a primary mechanical link in the form of a transition bar 590. As such, an opening of the latch actuation handle 582 via rotating the latch actuation handle 582 causes a linear displacement of the transition bar 590 in the direction of arrow B as shown in FIG. 19. The axis of rotation of the handle element 582 is seen to extend parallel to the plane of movement of the transition bar 590.

The transition bar 590 includes a first section 592 and a second section 594 joined by a right angle bend section 596. The bend section 596 laterally spaces the sections 592 and 594 from one another, but the sections 592 and 594 are oriented to extend generally parallel to one another. The transition bar 590 and the sections 592, 594, 596 may be formed as coplanar sections of a metal piece in one embodiment.

A distal end of the section 594 of the transition bar 590 includes an elongated slot 598 receiving a pin 600 that is in turn fixed to a secondary mechanical link in the form of a rotational actuator element 602. The rotational actuator element 602 is in turn rotatably mounted to a latch plate 604 via a pin 606. The rotational actuator element 602 includes a leading edge 608 including an opening that receives and engages an end of a latch release lever 610 of a latch element 612.

In a contemplated embodiment, the latch element 612 may be an electronic rotary latch available from Southco® (https://www.southco.com/en-us/), although other latch elements are possible. With such an electronic rotary latch, the latch may be released in an automatic manner via a control signal from the game controller 220 or 302 in the embodiments above or by another control element. The assembly 510 and the links 590 and 602 provide a manual mechanism to open the latch element 612 in the event of power loss, or at another time as desired, by actuating the latch release lever 610 as a mechanical over-ride. In an alternative embodiment, an electronic latch need not be included and the links 590, 592 may operate a mechanical latch element via a latch release lever with similar effect. The actuation mechanism accordingly does not necessarily require an electronic latch.

As the transition bar 590 is displaced in the direction of Arrow B by rotation of the handle element 582, the relative location of the pin 600 with respect to the slot 598 in the transition bar section 596 is changed. When the transition bar 590 is sufficiently displaced in the direction of Arrow B, the end of the slot 598 engages the pin 600 and further displacement of the transition bar causes the rotational actuator element 602 to rotate in the direction of Arrow C as shown in FIG. 20. The rotation of the actuator element 602 displaces the leading edge 608 and moves the latch release lever 610, causing the latch element 612 to release so that the flange 504 and the attached button deck 502 may be moved to the extended position via the drawer slider assemblies 506, 508. The axis of rotation of the actuator element 602 is seen to be perpendicular to an axis of rotation of the handle element 582, and the linear movement of the transition bar 590 occurs in a perpendicular orientation to both the rotation axes of the elements 602 and 582.

When the latch actuator handle 584 is released by the user, the handle 584 returns to its closed position and the end of the section 592 of the transition bar 590 is no longer displaced in the direction of arrow B. As such, the section 592 of the transition bar 590 moves linearly in a direction opposite to arrow B to an initial position wherein the pin 600 disengages the end of the slot 598 in the second section 594 of the transition bar 590. The leading edge 608 of the rotational actuator element 602 does not disengage, however, from the latch release element 610. As such, the leading edge 608 of the rotational actuator element 602 remains positively engaged with the latch lever 610 whether or not the latch handle element 584 is opened or closed. Only when the latch handle element 584 is opened, however, is the latch release 610 moved to cause the latch element 612 to release.

The actuation mechanism described is advantageous in that it operates as a direct actuation, push-to-release mechanism. This avoids a more complicated and indirect, pull-to-release mechanism including pull cable connections that have conventionally been utilized in gaming machines. The direct actuation, push-to-release mechanism is simpler to fabricate and assemble, as well as avoids reliability issues of pull cable connections. The combination of a linear actuator element 590 and a rotational element 602 is also relatively compact and offers space savings beneath the button deck 502.

The benefits and advantages of the slide-out button deck assemblies are now believed to have been amply illustrated in the exemplary embodiments disclosed.

An embodiment described herein provides a button deck assembly including: a button deck including a video display and a glass insulator provided with a capacitive touch screen layer overlying the video display; a flange surrounding at least a portion of the button deck, the flange being a single piece cast element formed with a front side and first and second lateral sides depending from the front side; and first and second drawer slide assemblies coupled to the respective first and second lateral sides of the flange. The first and second lateral sides of the flange respectively define a first channel receiving a portion of the first or second drawer slide assemblies.

Embodiments are disclosed wherein the button deck assembly includes the first and second lateral sides of the flange further defining a second channel distinct from the first channel, the glass insulator being surrounded by the second channel. The button deck may further include a bracket coupled to the glass insulator, with the bracket including a rim that extends beyond a periphery of the glass insulator. The rim may be received in the second channel of each of the first and second lateral sides of the flange. Each of the first and second lateral sides of the flange may be formed with an anchor section extending between the first and second channels, and one of the first and second drawer slide assemblies is coupled to each anchor section.

Embodiments are disclosed wherein the button deck further includes a bracket coupled to the glass insulator. The bracket may include a pair of threaded posts, and each anchor section may include an aperture at one end thereof, wherein each respective one of the pair of threaded posts is self-aligning with each aperture in each anchor section when the bracket is assembled to the flange.

Embodiments are disclosed wherein the glass insulator includes at least one opening, and the button deck further includes a mechanical pushbutton received in the at least one opening. The mechanical pushbutton may be mechanically isolated from the video display.

Embodiments are disclosed wherein the button deck also includes a latch element and a manually operable push-to-release mechanism for releasing the latch element. The manually operable push-to-release mechanism may include a rotatable handle element, a linearly movable link, and a rotational link coupled to a release lever of the latch element. The linearly movable link may include first and second sections extending parallel to one another, and a right angle section extending between the first and second sections. One of the first and second sections includes an elongated slot and the rotational link includes a pin, the pin being received in the elongated slot. The rotatable handle may be rotatably mounted to pivot about a first rotational axis, causing the linearly movable link to be displaced and rotate the rotational link about a second rotational axis perpendicular to the first rotational axis.

In some of the embodiments disclosed, the button deck assembly may be provided in combination with a cabinet and a main video display. The button deck assembly may also be provided in combination with a game controller. One of the button deck and the flange may include at least one projection and the other of the button deck and the flange includes at least one opening, with the at least one projection and the at least one opening being mated to interlock the button deck and the flange.

Another embodiment described herein provides a gaming machine including: a button deck including a video display and a glass insulator provided with a capacitive touch screen layer overlying the video display; a flange surrounding at least a portion of the button deck; first and second drawer slide assemblies coupled to the flange; and a latch element and a manually operable push-to-release mechanism for releasing the latch element.

Embodiments of gaming machines described herein may include the manually operable push-to-release mechanism having a rotatable handle element, a linearly movable link, and a rotational link coupled to a release lever of the latch element. The linearly movable link includes first and second sections extending parallel to one another, and a right angle section extending between the first and second sections, with one of the first and second sections including an elongated slot and the rotational link including a pin, the pin being received in the elongated slot. The rotatable handle element is rotatably mounted to pivot about a first rotational axis, causing the linearly movable link to be displaced and rotate the rotational link about a second rotational axis perpendicular to the first rotational axis.

As additional options, embodiments of gaming machines are disclosed wherein the flange may be a single piece cast element formed with a front side and first and second lateral sides depending from the front side, wherein the first and second lateral sides of the flange respectively define a first channel receiving a portion of the first and second drawer slide assemblies. The first and second lateral sides of the flange further define a second channel distinct from the first channel, with the glass insulator being surrounded by the second channel. The button deck may also include a bracket coupled to the glass insulator, with the bracket including a rim that extends beyond a periphery of the glass insulator. The rim is received in the second channel of each of the first and second lateral sides of the flange. Each of the first and second lateral sides of the flange may also be formed with an anchor section extending between the first and second channels, and one of the first and second drawer slide assemblies is coupled to each anchor section.

The button deck of disclosed embodiments of gaming machines may optionally further include a bracket coupled to the glass insulator, the bracket including a pair of threaded posts. Each anchor section includes an aperture at one end thereof, and each respective one of the pair of threaded posts is self-aligning with each aperture in each anchor section when the bracket is assembled to the flange. Also, one of the button deck and the flange includes at least one projection and the other of the button deck and the flange includes at least one opening, with the at least one projection and the at least one opening being mated to interlock the button deck and the flange. The glass insulator may include at least one opening. The button deck may include a mechanical pushbutton received in the at least one opening. The mechanical pushbutton is mechanically isolated from the video display.

Embodiments of gaming machines disclosed may optionally include a cabinet and a main video display. The gaming machine may also include a game controller.

Another embodiment described herein provides a gaming system including a button deck. The button deck includes a video display, a glass insulator provided with a capacitive touch screen layer overlying the video display, and a bracket including a rim extending past an outer periphery of the glass insulator. The button deck also includes a flange surrounding at least a portion of the button deck, the flange being a single piece cast element formed with a front side and first and second lateral sides depending from the front side. First and second drawer slide assemblies are coupled to the respective first and second lateral sides of the flange. The first and second lateral sides of the flange respectively define a first channel receiving a portion of the first or second drawer slide assemblies and a second channel receiving the rim and surrounding the outer periphery of the glass insulator. The button deck also includes a latch element and a manually operable push-to-release mechanism for releasing the latch element.

Optionally, further embodiments of a gaming system described herein may include that the manually operable push-to-release mechanism includes a rotatable handle element, a linearly movable link, and a rotational link coupled to a release lever of the latch element. A rotational axis of the rotatable handle element extends perpendicularly to a rotational axis of the rotational link. The gaming system may additionally include a game controller, a cabinet, and a main display.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A slide-out gaming interface comprising:

a button deck assembly comprising a video display, a glass insulator, and a capacitive touch screen layer overlying the video display;

a single piece cast flange surrounding a portion of the button deck assembly, the flange including a front side, first and second lateral sides depending from the front side, and at least one rib extending inwardly from the first and second lateral sides, the at least one rib defining an upper channel surrounding an outer periphery of the glass insulator and a lower channel extending beneath the upper channel; and first and second drawer slide assemblies coupled to the respective first and second lateral sides of the flange in the lower channel, wherein the button deck assembly is positioned at least partially within the upper channel and is supported from beneath by the at least one rib, wherein one of the button deck assembly and the flange comprises at least one projection and wherein the other of the button deck assembly and the flange comprises at least one opening, the at least one projection and the at least one opening being mated to interlock the button deck assembly and the flange.

2. The slide-out gaming interface of claim 1, wherein at least one of the upper channel and the lower channel is inclined to provide drainage of a fluid spilled on the glass insulator toward a rear end of the flange.

3. The slide-out gaming interface of claim 1, further comprising a bracket coupled to the glass insulator, the bracket including a rim that extends beyond a periphery of the glass insulator, and the bracket received in the upper channel to provide a degree of waterproofing to prevent a spill on a top surface of the glass insulator from damaging the video display.

4. The slide-out gaming interface of claim 3, wherein the bracket includes at least one threaded post that is self-aligning with the at least one rib.

5. The slide-out gaming interface of claim 4, wherein each respective one of the first and second drawer slide assemblies is fastened to the at least one rib on the first or second lateral side of the flange.

6. The slide-out gaming interface of claim 1, wherein the glass insulator includes at least one opening, and a mechanical pushbutton is received in the at least one opening.

7. The slide-out gaming interface of claim 6, wherein the mechanical pushbutton is mechanically isolated from the video display.

8. The slide-out gaming interface of claim 1, wherein the flange includes a series of spaced apart projections on an interior surface of the front side, and wherein the button deck assembly includes a series of spaced apart openings on a leading edge thereof and mating with the spaced apart projections to secure the button deck assembly to the flange at the front side.

9. The slide-out gaming interface of claim 1, in combination with a gaming support structure and a main video display.

10. A manually operable push-to-release latch mechanism for a slide-out button deck assembly secured to a gaming machine by a latch element including a release lever, the latch mechanism comprising:

a rotatable handle element coupled to the button deck assembly and being movable from a closed position to an open position on an exterior of the button deck assembly;

a linearly movable link mounted interior to the button deck assembly, the linearly movable link including a first end and a second end, wherein the first end is displaced by a manual rotation of the rotatable handle element; and a rotational link coupled to the second end of the linearly movable link and actuating the release lever of the latch element when the linearly movable link is displaced.

11. The latch mechanism of claim 10, wherein the linearly movable link comprises first and second sections extending parallel to one another, and a right angle section extending between the first and second sections.

12. The latch mechanism of claim 11, wherein an end of the first section includes an elongated slot and wherein the rotational link includes a pin, the pin being received in the elongated slot.

13. The latch mechanism of claim 10, wherein the rotatable handle is biased to the closed position.

14. The latch mechanism of claim 10, wherein the rotatable handle element is rotatable about a first rotational axis, and the rotational link is rotatable about a second rotation axis, wherein the second rotational axis is perpendicular to the first rotational axis.

15. The latch mechanism of claim 10, wherein the latch element is an electronic rotary latch.

16. A gaming system comprising:

a gaming support structure;

a game controller; and a slide-out player interface coupled to the game support structure and operationally responsive to the game controller, the slide-out player interface comprising:

a button deck in communication with the game controller and including video display, a glass insulator, and a capacitive touch screen layer on the glass insulator overlying the video display;

a bracket including a rim extending past an outer periphery of the glass insulator;

a flange surrounding at least a portion of the button deck, the flange being a single piece cast element formed with a front side, first and second lateral sides depending from the front side, and at least one rib extending inwardly from the first and second lateral sides, the at least one rib defining an upper channel and a lower channel, the upper channel receiving the rim to provide a degree of waterproofing to prevent a spill on a top surface of the glass insulator from damaging the video display;

first and second drawer slide assemblies coupled to the lower channel in each respective first and second lateral side of the flange and also coupled to the gaming support structure; and a latch element and a manually operable push-to-release mechanism for releasing the latch element from the gaming support structure, wherein the button deck is positioned at least partially within the upper channel and is supported from beneath by the at least one rib, wherein one of the button deck and the flange comprises at least one projection and wherein the other of the button deck and the flange comprises at least one opening, the at least one projection and the at least one opening being mated to interlock the button deck and the flange.

17. The gaming system of claim 16, wherein the player interface further includes at least one dynamic mechanical pushbutton that is mechanically isolated from the video display.

18. The gaming system of claim 16, wherein at least one of the upper channel and the lower channel is inclined to provide drainage of a fluid spilled on the glass insulator toward a rear end of the flange.

19. The gaming system of claim 16, wherein the latch element includes a release lever, and wherein the manually operable push-to-release mechanism latch mechanism comprises:

a housing coupled to the flange;

a rotatable handle element being movable from a closed position to an open position on an exterior of the housing;

a linearly movable link mounted interior to the housing, the linearly movable link including a first end and a second end, wherein the first end is displaced by a manual rotation of the rotatable handle element; and a rotational link coupled to a second end of the linearly movable link and actuating the release lever of the latch element when the linearly movable link is displaced.

* * * * *